US005341841A

United States Patent [19]

Schaefer

[11] Patent Number: 5,341,841

[45] Date of Patent: Aug. 30, 1994

[54] FLUID DISTRIBUTION DEVICE

[75] Inventor: Joseph H. Schaefer, Grafton, Wis.

[73] Assignee: Acute Ideas, Inc., Grafton, Wis.

[21] Appl. No.: 139,244

[22] Filed: Oct. 19, 1993

[51] Int. Cl.[5] ..... F15D 1/14

[52] U.S. Cl. ..... 137/561 A; 137/561 R

[58] Field of Search ..... 137/561 R, 561 A, 884

[56] References Cited

U.S. PATENT DOCUMENTS

| | | | |
|---|---|---|---|
| 3,001,544 | 9/1961 | Fergason | 137/262 |
| 3,391,703 | 7/1968 | Kay | 137/884 X |
| 3,658,088 | 4/1972 | Jensen et al. | 137/884 X |
| 3,760,844 | 9/1973 | Olson et al. | 137/884 |
| 3,795,259 | 3/1974 | Brandlin et al. | 137/561 A |
| 3,814,126 | 6/1974 | Klee | 137/884 |
| 3,934,605 | 1/1976 | Legris | 137/884 X |
| 3,991,786 | 11/1976 | Olson | 137/561 R |
| 4,299,553 | 11/1981 | Swaroop | 137/561 A X |
| 4,333,629 | 6/1982 | Roy | 137/561 A X |
| 4,535,821 | 8/1985 | Anderson | 137/884 |
| 4,537,217 | 8/1985 | Allen, Jr. | 137/561 A |
| 5,176,359 | 1/1993 | Leveson et al. | 251/61.1 |
| 5,178,191 | 1/1993 | Schaefer | 137/884 |

*Primary Examiner*—John Rivell

*Attorney, Agent, or Firm*—Quarles & Brady

[57] ABSTRACT

A fluid distribution device which can direct the flow of a fluid from a common source to a plurality of outlet ports wherein a distribution plate is sandwiched between members which serve as inlet and outlet ports. In a preferred manner, there is a flow restrictor in the distribution plate which is provided by passages extending through the plate. The members are symmetrical in configuration with one of the members providing as inlet port and both members providing outlet ports. This results in cost reduction. The fluid distribution device is particularly suitable for use with pneumatic control systems.

11 Claims, 4 Drawing Sheets

FIG. 1
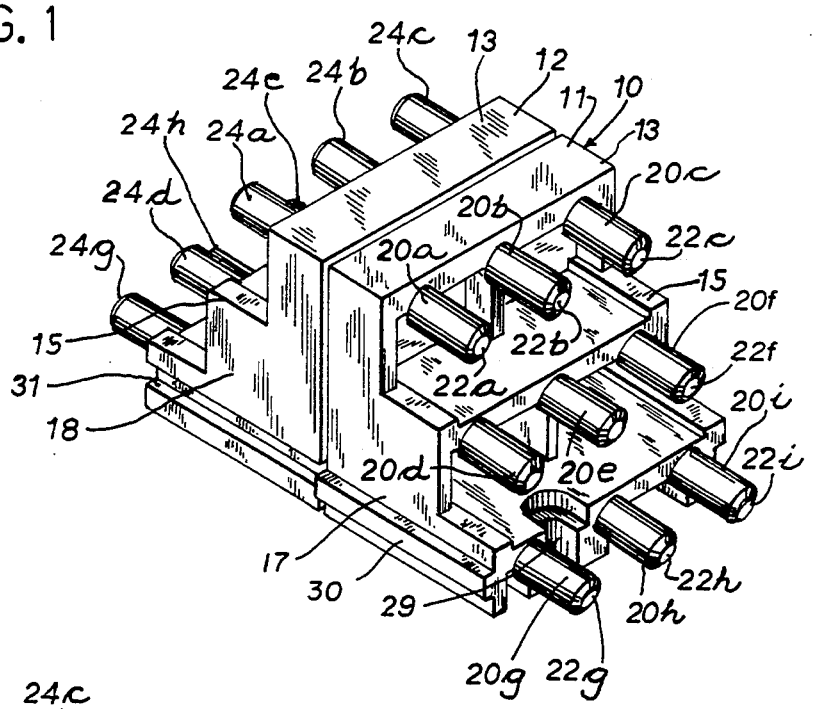
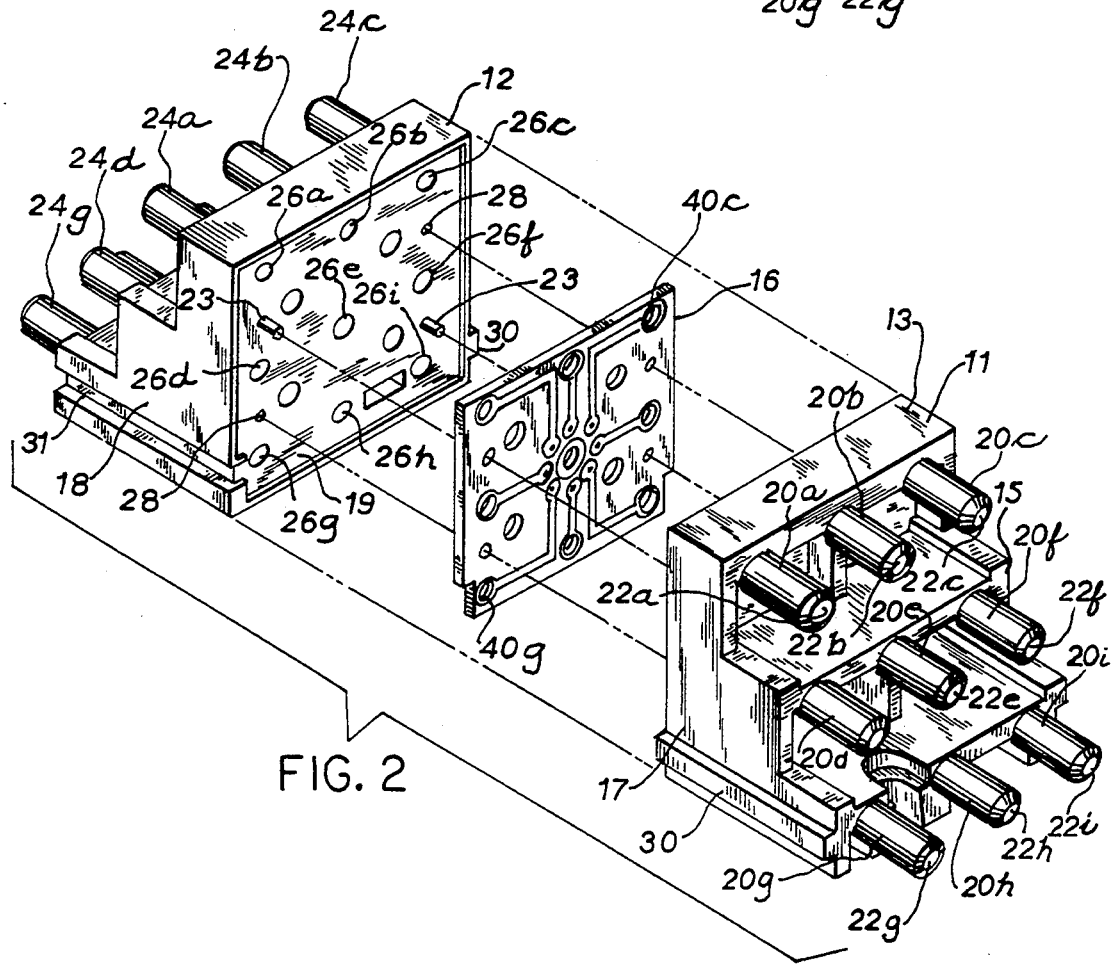

FLUID DISTRIBUTION DEVICE

BACKGROUND OF THE INVENTION

This invention relates to fluid distribution devices, and particularly, such devices which can reduce fluid flow and thus are particularly suited for use in conjunction with pneumatic control systems.

Fluid distributors employing two body members with a distribution plate therebetween are well known. One is shown in U.S. Pat. No. 4,537,217. The use of membranes in fluid distributors are also known. One is described in U.S. Pat. No. 5,176,359. In U.S. Pat. No. 3,991,786, a fluid distribution plate is described for use in conjunction with logic control valve devices.

While the prior art provides fluid distribution devices of various types and configurations, they do not afford a simplified device wherein opposing members of the devices are identical and an intermediate distribution plate can effect a predetermined flow restriction.

It is an advantage of the present invention to provide a fluid distribution device which has symmetrical components and thus reduces cost to manufacture.

It is another advantage of the present invention to provide a fluid distribution device of the foregoing type which can effect a determined flow rate.

It is yet another advantage of the present invention to provide a fluid distribution device of the foregoing type which is useful in conjunction with pneumatic control systems.

It is still another advantage of the present invention to provide a fluid distribution device of the foregoing type which can be connected in a modular manner.

SUMMARY OF THE INVENTION

The foregoing advantages are accomplished and the shortcomings of the prior art are overcome by the present device for distributing fluid from a single inlet to a multiplicity of outlets which includes a first member having a first side with at least one inlet port on the first side and a passage extending from the inlet port to a second side of the first member. There is a second member having a first side and a plurality of port passages extending between the first side and a second side of the second member. A third member is placed between the second sides of the first and second members with a passage in the third member communicating with the inlet port of the first member. A plurality of passages in the third member communicate with the passage in communication with the inlet port at one side with the plurality of passages extending through the third member from the one side to another side and connected to channel portions extending over the other side, the plurality of passages communicating with the port passages of the second member.

In one preferred embodiment, the plurality of passages extending through the third member include a flow restrictor therein.

In one aspect, the third member is composed of a sheet like material and the first and second members include tubular projections arranged in tiered rows and provide extensions of the port passages.

In another preferred embodiment, the passage in the third member communicating with the inlet port has a circular portion with radiating portions extending therefrom.

In still another preferred embodiment, the fluid distribution device can be connected to an additional device in a modular manner.

In yet another preferred embodiment, the port passages of the second member are adapted to be connected to a sensing device and some of the port passages of the first member are adapted to be connected to a control device.

BRIEF DESCRIPTION OF THE DRAWINGS

FIG. 1 is a top perspective view showing the fluid distribution device of this invention.

FIG. 2 is an assembly view of the device shown in FIG. 1.

DESCRIPTION OF THE PREFERRED EMBODIMENTS

Figure 3:
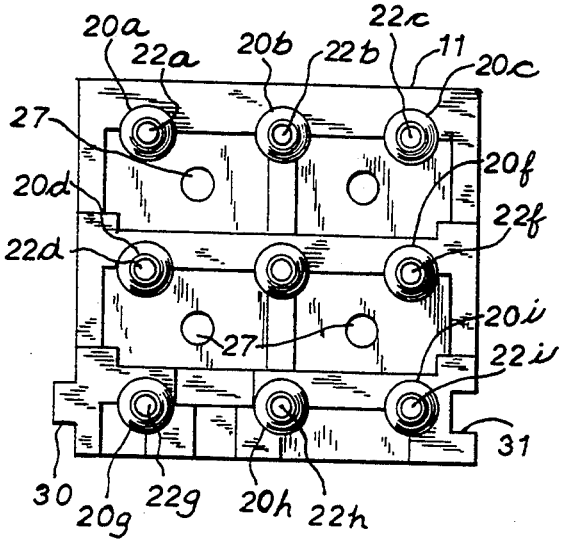
FIG. 3 is a view in side elevation showing one of the body members composing the distribution device of FIG. 1.

Referring to FIGS. 1–4, the distribution device generally 10 includes two identical body members 11 and 12 each having top walls 13, a tiered front wall 15, end walls 17 and 18 and back walls 19. Sandwiched between the body members 11 and 12 is a distribution member 16 in the form of a sheet like material.

Figure 4:
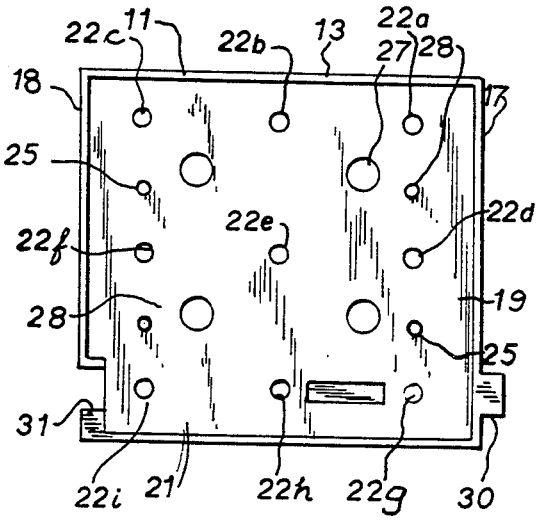
FIG. 4 is a view similar to FIG. 3 except showing a rear view of the body member.

Body member 11 has nine tubular members as shown at 20*a*–*i* which are arranged in three tiered rows. Each of these tubular members have passages 22*a*–*i* which extend from the tiered front wall 15 to the back wall 19 as best seen in FIG. 4. Body member 12 is identical to body member 11 with the tubular members 24*a*–*i* having passages 26*a*–*i* which extend from the front wall 15 to the back wall 19 in a similar manner. This is best seen in FIG. 2. It will be appreciated that all of the tubular members 20*a*–*i* and tubular members 24*a*–*i* are in respective alignment when the body members are interconnected as are the respective passages 22*a*–*i* and 26*a*–*i*.

Figure 9:
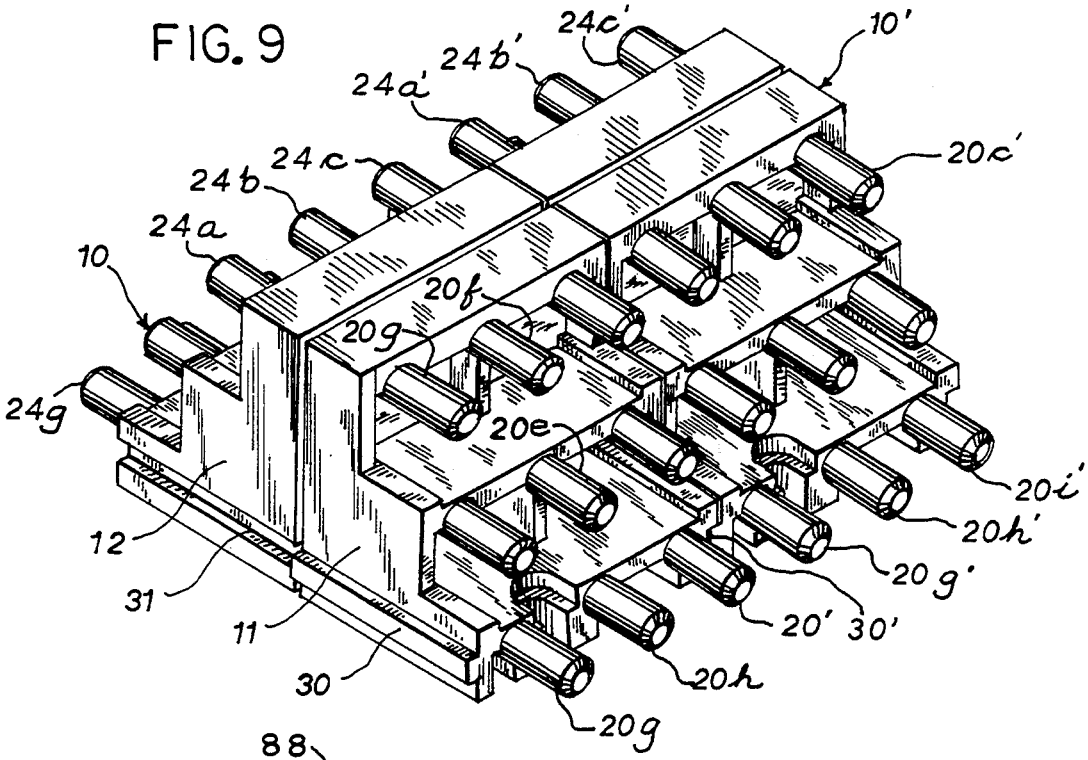
FIG. 9 is a perspective view showing two of the distribution devices connected in a modular manner.

Locating pegs 23 and 25 extend from the back walls 19 of body members 11 and 12 for reception in corresponding openings 28 in the opposing back walls 19. Additional and larger passageways 27 extend through body members 11 and 12 for the purpose of allowing fasteners to be placed therethrough to connect the body members 11 and 12 together in a permanent manner. It will also be seen that there is a U shaped recess 29 in body member 11 for purposes of securing it to a support surface. A similar recess is provided in body member 12. In addition bar members 30 extend laterally from one side of the body members 11 and 12 and a groove 31 extends from the opposing side. This is for the purpose of interconnecting several of the devices together as shown in FIG. 9 with the interconnection of body members 11' and 12' to body members 11 and 12.

Figure 5:
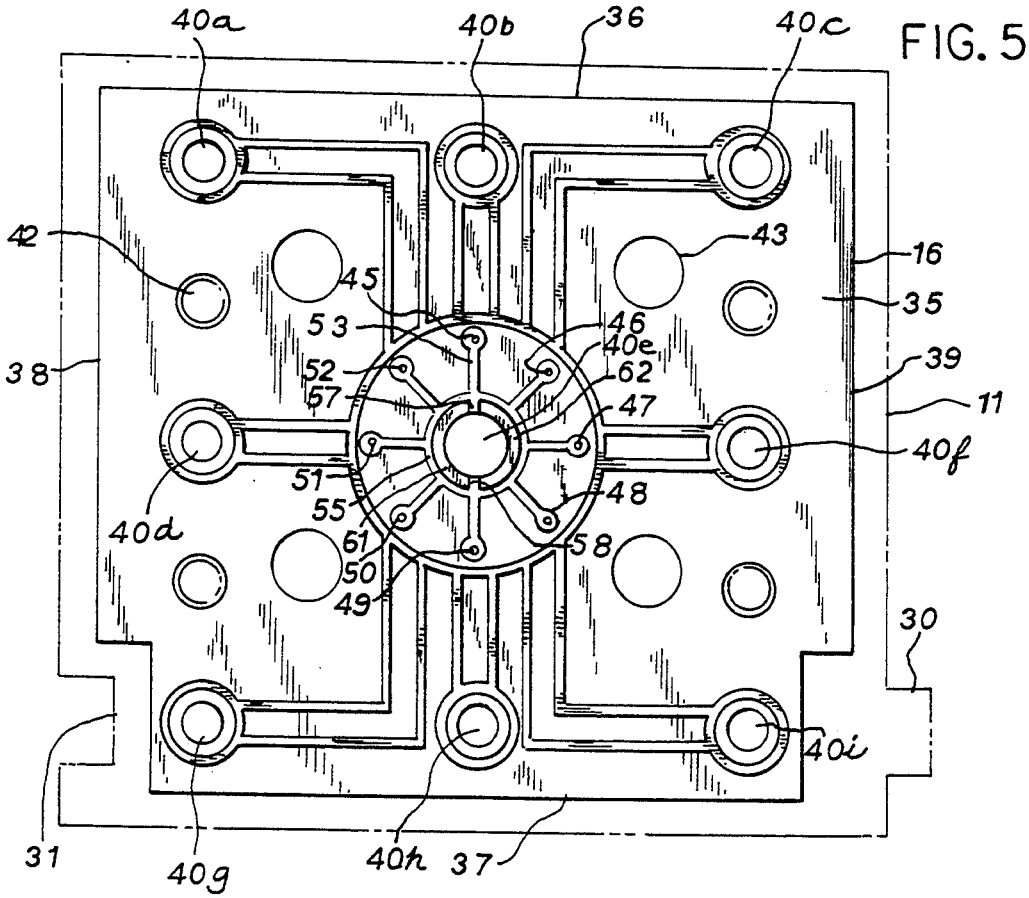
FIG. 5 is an enlarged view in side elevation showing a distribution member for sandwiching between the body members.
Figure 6:
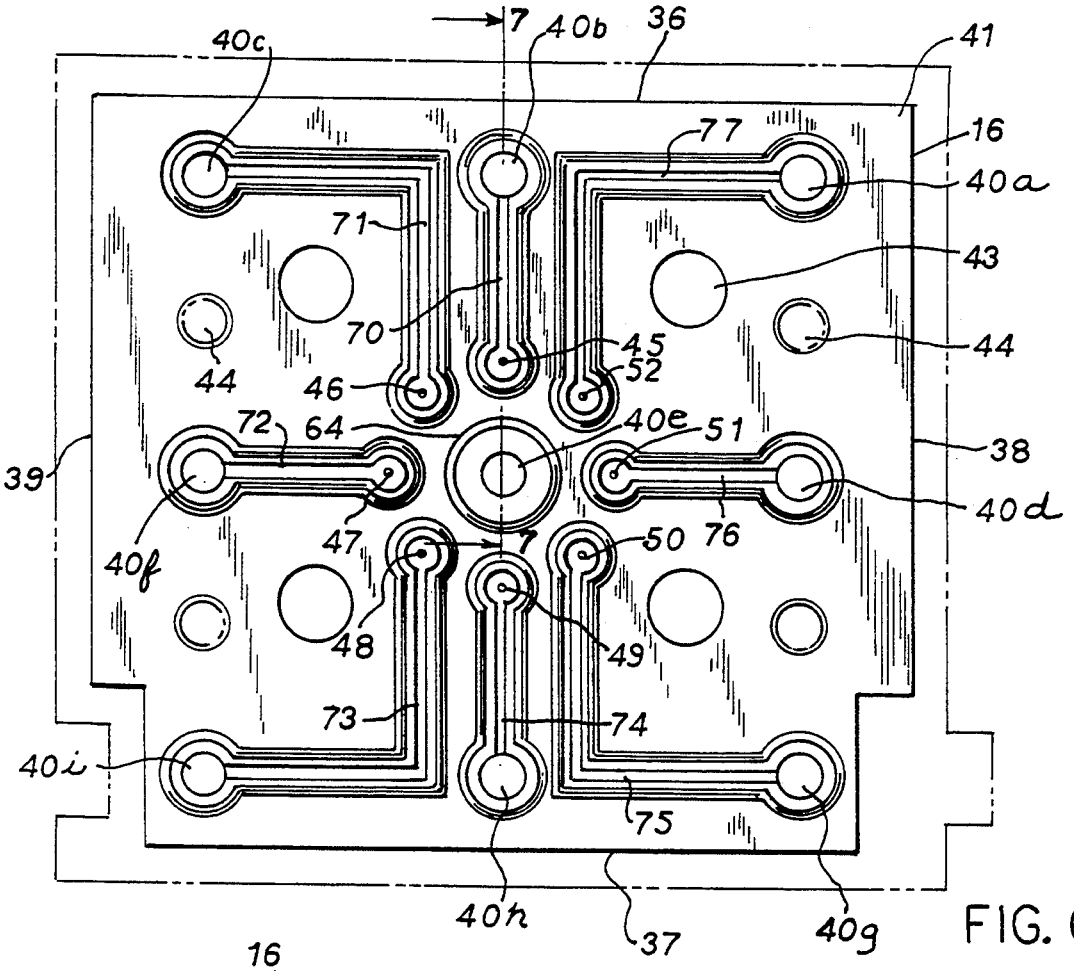
FIG. 6 is a view similar to FIG. 5 except being a rear view of the distribution member.

Referring specifically to FIGS. 2, 5 and 6, the distributor member 16 has a top edge 36, a bottom edge 37 and side edges 38 and 39. It also has opposing sides 35 and 41. Passages 40*a–i* correspond with passages 22*a–i* and 26*a–i* of respective body members 11 and 12 and are in alignment therewith when the distribution member 16 is sandwiched between them. They extend between the opposing sides 35 and 41. Openings 42 accommodate pegs 23 and passages 43 correspond to passageways 27.

Referring specifically to FIG. 5, it is seen that a plurality of smaller apertures 45–52 are spaced on side 35 of the distribution member 16 in a circular manner with respect to central passage 40*e*. In a manner similar to passages 40*a–i*, they also extend between sides 35 and 41. Linear channels 53 extend from apertures 45–52 and interconnect with circular channel 55. Grooves 57 and 58 extend between arcuate walls 61 and 62 and in turn connect circular channel 55 and central passage 40*e*. Looking at the other side 41 of distribution member 16 in FIG. 6 it is seen that the passages 40*a–i* interconnect with the apertures 45–52 by means of the channels 70–77. Channels 70, 72, 74, and 76 are rectilinear whereas channels 71, 73, 75, and 77 are orthogonal.

Figure 7:
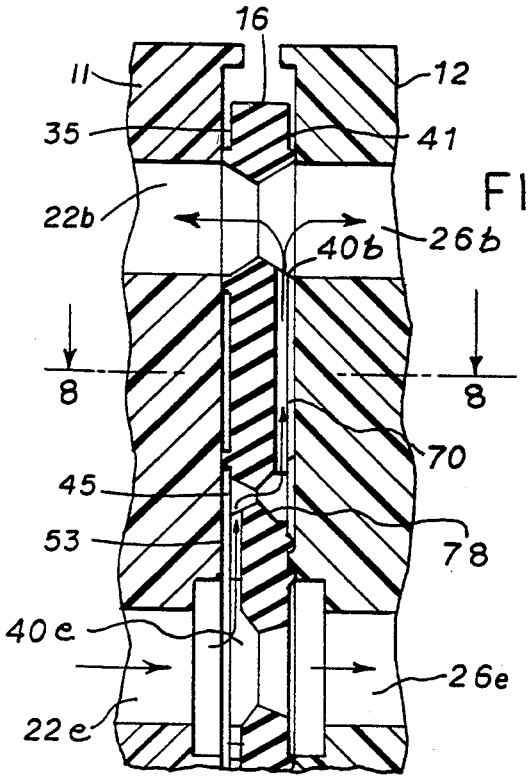
FIG. 7 is a view in vertical section taken along line 7—7 of FIG. 6.

Referring specifically to FIG. 7, pressurized air which enters the central passage 22*e* of body member 11 will move through the linear channel 53 on side 35 of the distribution member 16 and then pass through a restriction 78 in aperture 45 and then along channel 70 on the opposing side to opposing passages 22*b* and 26*b* in respective body members 11 and 12. This flow pattern will be the same with respect to each linear channel 53 and the remaining respective apertures 46–52. As seen in FIG. 6 and referred to earlier, air flow from each of the apertures 45–52 on side 41 of the distribution member 16 is to the respective passages 40*a–i* by means of the respective channels 70–77.

Accordingly, the flow path of fluid through the body members 11 and 12 and distributor member 16 is for the pressurized air to be connected to the central tubular member 20*e* of body member 11 with flow through the passage 40*e*, the grooves 57 and 58, into the circular channel 55 and then into the linear channels 53. After passing through the restriction 78 of each aperture 45–52 the air flows by means of the channels 70–77 to the opposing passages 22*a–d, f–i* and 26*a–d, f–i*. With respect to central passage 22*e* of body member 11, central passage 40*e* of distribution member 16 and 26*e* of body member 12, these provide a through passage so that air can be interconnected through tubular member 24*e* at the opposing side and thus for interconnection with similar distribution devices or for other applications. Alternatively, air could be initially introduced into tubular member 24*e* rather than member 20*e*.

Figure 8:
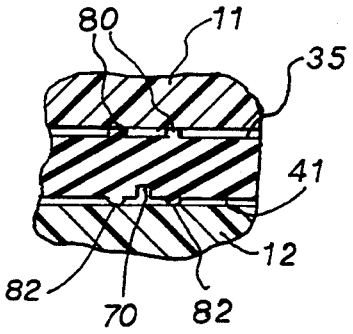
FIG. 8 is a view in vertical section taken along line 8—8 of FIG. 7.

Referring to FIG. 8, it is seen that the channels such as 70 have ribs 82 at opposing sides thereof on side 41 of distribution member 16. On the opposing side 35 there are the bars 80 which are a result of the molding of this member. However these bars 80 can be eliminated if desired.

Referring to FIG. 9, there is illustrated a similar distribution device 10' interconnected with distribution device 10. This is effected by connecting the respect body sections 11 and 12 with similar body sections 10' and 11' by means of the bar members 30 and grooves 31.

Figure 10:
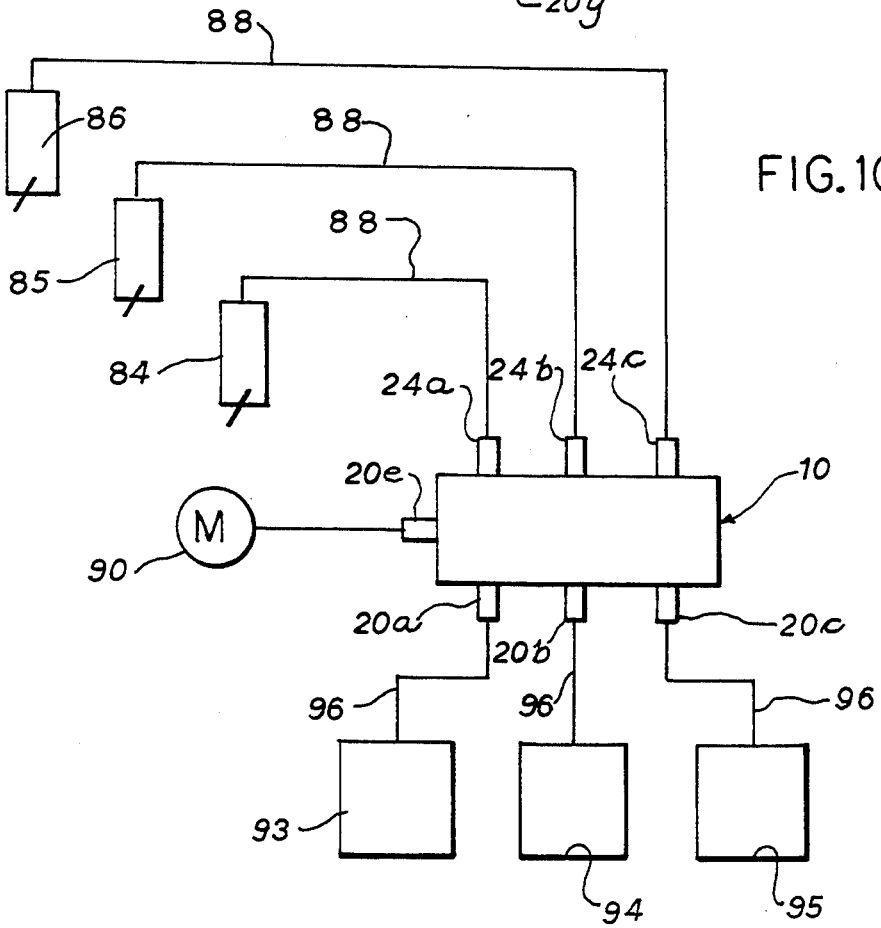
FIG. 10 is a diagrammatic view showing an application of the distribution device.

FIG. 10 represents a practical application of distribution device 10 for illustration purposes wherein it is used to control the heating or cooling of air. Pressurized air as from source 90 is interconnected to central member 20*e* by means of pressurized air line 91. In this instance and for illustration purposes the tubular member 20*e* is shown at the side of distribution device 10 rather than on the same side as the tubular members 20*a–i* shown in FIGS. 1 and 2. Air is distributed through distribution device 10 through tubular members such as 24*a–c* at one side to sensors 84, 85, 86 interconnected by means of lines 88. At the opposite side connection is made through tubular members such as 20*a–c* to modular control units 93, 94, and 95 of the type described in U.S. Pat. No. 5,178,191. The modular control blocks 93–95 interconnected by the lines 96 operate in the manner fully described in the previously mentioned patent and provide the desired signal thereto.

The preferred material for composing the body members 11 and 12 is a ridged molded thermoplastic available from General Electric Company as Prevex resin. However other suitable materials could be used such as die cast aluminum. Distribution member 16 is preferably composed of a Texin 355D plastic resin available from Miles Inc. Other materials such as rubber or flexible plastics could be substituted if desired.

An important feature of distribution device 10 is not only its ability to distribute fluid to a multiplicity of passages but that it also can reduce flow such as by means of restriction 78 in the apertures 45–52. Thus it is particularly suitable for use with a pneumatic sensor and a pneumatic control.

In order to assure proper sealing between the various passages and channels in the body members 11 and 12 and the distribution member 16, a gasket could be placed on each side of the distribution member 16 and between it and the body members 11 and 12. The gaskets would, of course, have the same corresponding passages and channels to allow the passage of fluid. Apertures 45–52 are molded during the fabrication molding process. If desired, and to eliminate any problem with flash, these apertures could be laser drilled.

It will thus be seen that from the previously described invention there is now provided a fluid distribution device which by means of two body sections and a distribution member can distribute air to various apertures as well as provide a reduced flow rate. Substantial cost savings is thereby effected over the prior art which utilizes separate supply lines for a control and sensor and connection through a manifold.

While the fluid distribution device of this invention is useful in conjunction with controls for heating or cooling of air, it is adaptable to any control function where fluid input is required for various sensors and control units.

It will be apparent to those skilled in the art that a number of variations can be made of the preferred embodiments without departing from the spirit of the invention. For example, while a designated number of tubular members 20*a–i* and 24*a–i* have been indicated with the respective passages, any number could be employed by increasing or decreasing the number of radially disposed apertures 45–52. These also could be positioned in different geometric configurations with respect to the central passage 40*e*. The same is true with respect to the respective passages 22*a–i*, 26*a–i* and tubular members 20*a–i*, 24*a–i*.

I claim:

1. A device for distributing fluid from a single inlet to a multiplicity of outlets comprising:

a first member having a first side with at least one inlet port on the first side;

a passage extending from the inlet port to a second side of the first member;

a second member having a first side;

a plurality of port passages extending between the first side and a second side of the second member;

a third member placed between the second sides of the first and second members;

a passage in the third member communicating with the inlet port of the first member;

a plurality of passages in the third member communicating with the passage in communication with the inlet port at one side, the plurality of passages extending through the third member from the one side to another side and connected to channel portions extending over the other side of the third member, the plurality of passages communicating with the port passages of the second member by means of the channel portions.

2. The device of claim 1 wherein the plurality of passages extending through the third member include a flow restrictor.

3. The device of claim 2 wherein the third member is composed of a sheet like material.

4. A device for distributing fluid from a single inlet to a multiplicity of outlets comprising:

a first member having a first side with at least one inlet port on the first side;

a passage extending from the inlet port to a second side of the first member.;

a second member having a first side;

a plurality of port passages extending between the first side and a second side of the second member;

a third member placed between the second sides of the first and second members;

a passage in the third member communicating with the inlet port of the first member;

a plurality of passages in the third member communicating with the passage in communication with the inlet port at one side, the plurality of passages extending through the third member from the one side to another side and connected to channel portions extending over the other side member, the plurality of passages communicating with the port passages of the second member, the third member having a plurality of additional passages extending through the third member from one side to the other side and the first member has a plurality of port members extending from the one side and in communication with the additional passages and the port passages of the second member.

5. The device of claim 4 wherein the port members of the first and second members include tubular projections arranged in tiered rows.

6. The device of claim 1 further including connecting members disposed on the first and second members for connection to additional body members.

7. The device of claim 1 further including slots disposed in the first and second members for attachment to a supporting surface.

8. The device of claim 4 wherein the port passages of the second member are adapted to be connected to a sensing device and the port passages of the first members are adapted to be connected to a control device.

9. The device of claim 1 wherein the passage in the third member communicating with the inlet port has a circular portion connected with radiating channel portions extending therefrom.

10. The device of claim 9 wherein some of the channel portions extending over the other side of the third member and communicating with the port passages of the second member are rectilinear and others are orthogonal.

11. The device of claim 1 wherein the first and second members are in certain instances essentially identical.

* * * * *